US005427129A

United States Patent [19]

Young, Jr. et al.

[11] Patent Number: 5,427,129

[45] Date of Patent: Jun. 27, 1995

[54] FIXED TOWER WATER DISTRIBUTION

[76] Inventors: Raymond A. Young, Jr., 1907 Essex St., Kinston, N.C. 28501; Bradley B. Hobday, 1315 Park Ave. B, Goldsboro, N.C. 27530

[21] Appl. No.: 228,128

[22] Filed: Apr. 15, 1994

[51] Int. Cl.[6] ..... B08B 3/02

[52] U.S. Cl. ..... 134/176; 134/179; 134/180; 239/264

[58] Field of Search ..... 134/176, 179, 180, 183, 134/57 D, 56 D, 58 D; 239/256.11, 251, 264

[56] References Cited

U.S. PATENT DOCUMENTS

| | | | |
|---|---|---|---|
| Re. 17,673 | 5/1930 | Zademach | 134/176 |
| 1,485,796 | 3/1924 | Merseles et al. | 134/176 |
| 1,733,249 | 10/1929 | Clinton | 134/179 |
| 1,900,529 | 3/1933 | Tatham | 134/176 X |
| 3,017,892 | 1/1962 | Mixon | 134/176 |
| 3,841,342 | 10/1974 | Cushing et al. | 134/176 X |
| 3,951,683 | 4/1976 | Jarvis, Jr. et al. | 134/176 X |
| 3,951,684 | 4/1976 | LaPrad et al. | 134/116 X |
| 4,134,414 | 1/1979 | Jarvis | 134/176 X |
| 4,174,723 | 11/1979 | Long . | |

*Primary Examiner*—Frankie L. Stinson

[57] ABSTRACT

A dishwasher has a pump mounted in the lower end of the tub to have outlet tube extending upward above the bottom of the tub. A wire rack has a fixed tower mounted on the rack with a rotatable spray tower journalled inside. A rotatable spray arm is mounted on the outlet of the pump and is moveable vertically into and out of engagement with the rotatable spray tower, with a spray arm having a downwardly extending collar carrying a seal that slides vertically on the outlet tube, while the wash arm rotates about the seal.

4 Claims, 5 Drawing Sheets

FIXED TOWER WATER DISTRIBUTION

BACKGROUND OF THE INVENTION

This invention relates generally to dishwashers of the household type and more particularly to tower type water distribution systems for providing a second level spray above the main dishwasher rack.

Nearly all domestic dishwasher units as made today include a lower washarm that rotates about a vertical axis. Most of the larger dishes are carried on a lower rack which rolls on wheels on ledges formed on the sides of the tub and out onto the fold down front door. An upper rack is also provided for smaller articles and cups and glasses, and it is mounted on rollers and channels near the top of the interior to also be movable in or out of the tub for loading and unloading. It has been found that a single rotary lower washarm does not always give good washability performance because the spray path can be blocked by the dishes on the lower rack and very little water may reach some articles on the upper rack. Therefore, nearly all dishwashers include an upper or second level spray mechanism to provide a spray both upward and downward beneath the upper rack to spray upward directly on the articles in that rack and downwardly onto the articles on the lower rack.

One approach has been to use a rotating washarm similar to the main or lower washarm and this upper washarm can either be mounted directly to the back of the washing machine tub which is not a structurally strong arrangement and allows the washarm and its mount to be easily damaged. An alternative arrangement is to mount the washarm directly to the upper rack and either make connection through a horizontal tube that engages a wash water supply at the back wall of the tub when the rack is held in the regular position when the door is closed, or to supply wash water to the upper rack by means of an elevating tower that rises up from the lower wash arm and makes a connection to the upper washarm.

Alternatively, the spray at this upper or intermediate level can be provided directly from the lower washarm by means of either a fixed or elevated tower mounted on the lower washarm so that wash water is supplied through the main washarm upwardly into the rotating tower and spray head. However, this suffers from the requirement of an elongated cut out in the lower rack to allow it to slide out around this tower and this central elongated cut out not only weakens the rack structurally but also takes up space and thereby reduces the capacity of the dishwasher for holding large dishes and pans.

Another approach which allows the rack to be complete except for the very center portion is to utilize a fixed tower that is mounted on the lower rack directly above the lower washarm. With this arrangement, when wash water enters the lower washarm, the arm, which is vertically moveable, moves upward by the water pressure and engages the tower mechanism and allows a portion of the water entering the lower washarm to enter the tower. By means of a driving connection, this fixed tower has a rotatable inner tower which therefore rotates with the lower washarm and provides a coordinated spray directly below the upper rack. Such an arrangement is shown in U.S. Pat. No. 4,174,723 granted Nov. 20, 1979 and assigned to the assignee of the present application. This arrangement has proved quite satisfactory, although it used a fabricated metal washarm with upper and lower inserts for engaging the rotatable tower and providing a bearing contact with the pump outlet. Such an arrangement, however, has one short coming in that any leakage, either between the washarm and the rotatable tower and between the pump outlet and the washarm decreases the amount of wash liquid available for spraying on the dishes and this reduces the general cleanability of the dishwasher. While the rotating upper tower has a rubber gasket that provides a fairly closed seal with the extension from the lower washarm, the rotating connection or seal between the lower washarm and the pump outlet has created sealing problems because of the tolerances required to eliminate any possible binding in this area.

SUMMARY OF THE INVENTION

According to preferred embodiment of this invention, the dishwasher has a lower rack adapted to slide in and out of the front opening wash tub. The rack is of the usual wire type and has an opening at its center on which is mounted a vertically extending fixed plastic tower having a relatively square base and hook members which attach the tower to the rack. Mounted inside the fixed tower is a rotatable tower having a spray head at the top and having a downwardly and outwardly flaring opening at the bottom directly below the lower rack.

In accordance with the usual practice, the motor and pump are mounted directly below the bottom center of the tub in a sump and the pump may have a filter member and an outlet extending upwardly above the tub bottom wall. This member provides a central upwardly opening outlet for the main wash circulation of the pump and this outlet is in vertical axial alignment with the tower. The washarm has a hub with two laterally extending spray arms, preferably formed as an integral unit. The pump outlet has a tubular extension having a cylindrical outer wall and a central hub which is connected to the outer wall by radially extending webs or vanes. The hub serves to mount a vertically extending shaft while the washarm in the central hub also has an inner hub connected by radial webs to the remainder of the washarm structure. The inner hub has a tubular opening which rides upon the vertical shaft to provide accurate bearing alignment for the entire washarm assembly as it rotates. The washarm is therefore arranged to move vertically from a lower position when the pump is off allowing vertical spacing between the top of the washarm and the rack to allow the rack to be moved easily in and out of the tub. When the pump runs in the wash mode, the washarm must move upward to an upper position to make sealing engagement with the rotary tower. Accordingly, the upper end of the central hub has a conically tapered configuration with a pair of laterally extending ribs and a reduced central opening. The lower end of the rotary tower has a rubber grommet as well as projecting ears, and when the washarm rises because of the pressure differential between the inlet and outlet openings, the ribs on the washarm hub engage the ears on the rotary tower and as sealing engagement is made between the hub and the rubber gasket, rotation of the washarm drives the rotary tower so that the spray head at the top of the rotary tower rotates with the lower washarm.

To provide proper sealing at the lower end of the washarm, it is provided with a downwardly extending collar having an inturned lip at the lower end of the collar. This lip carries a gasket having a C-shaped cross section which fits on the lip and has a smooth cylindrical inner surface which makes a relatively tight fit with the tubular extension on the pump. As the washarm rotates, this seal is able to move up and down the tubular extension of the pump to provide relatively tight sealing engagement, while the seal remains non-rotatable on the pump extension and the washarm rotates about the seal with the inturned lip engaging a groove on the seal.

Another feature of the present invention relates to the vertical movement of the washarm. The opening at the upper end leading to the tower is much smaller than the inlet, and this produces a pressure differential which allows the washarm to rise when the pump is in operation. However, such operation as well as proper spray performance for the washarm requires a minimum output of the pump in terms of rate of flow. According to the present invention, if the rate of flow is insufficient, additional openings are provided at the lower surface of the outer ends of the washarm to produce a downward spray whose reaction provides an upward force on the washarm. This downward spray is particularly beneficial during rinse since it sprays the bottom of the tub and tends to wash any accumulated particles into the sump and hence to drain.

DETAILED DESCRIPTION OF THE PREFERRED EMBODIMENT

Figure 1:
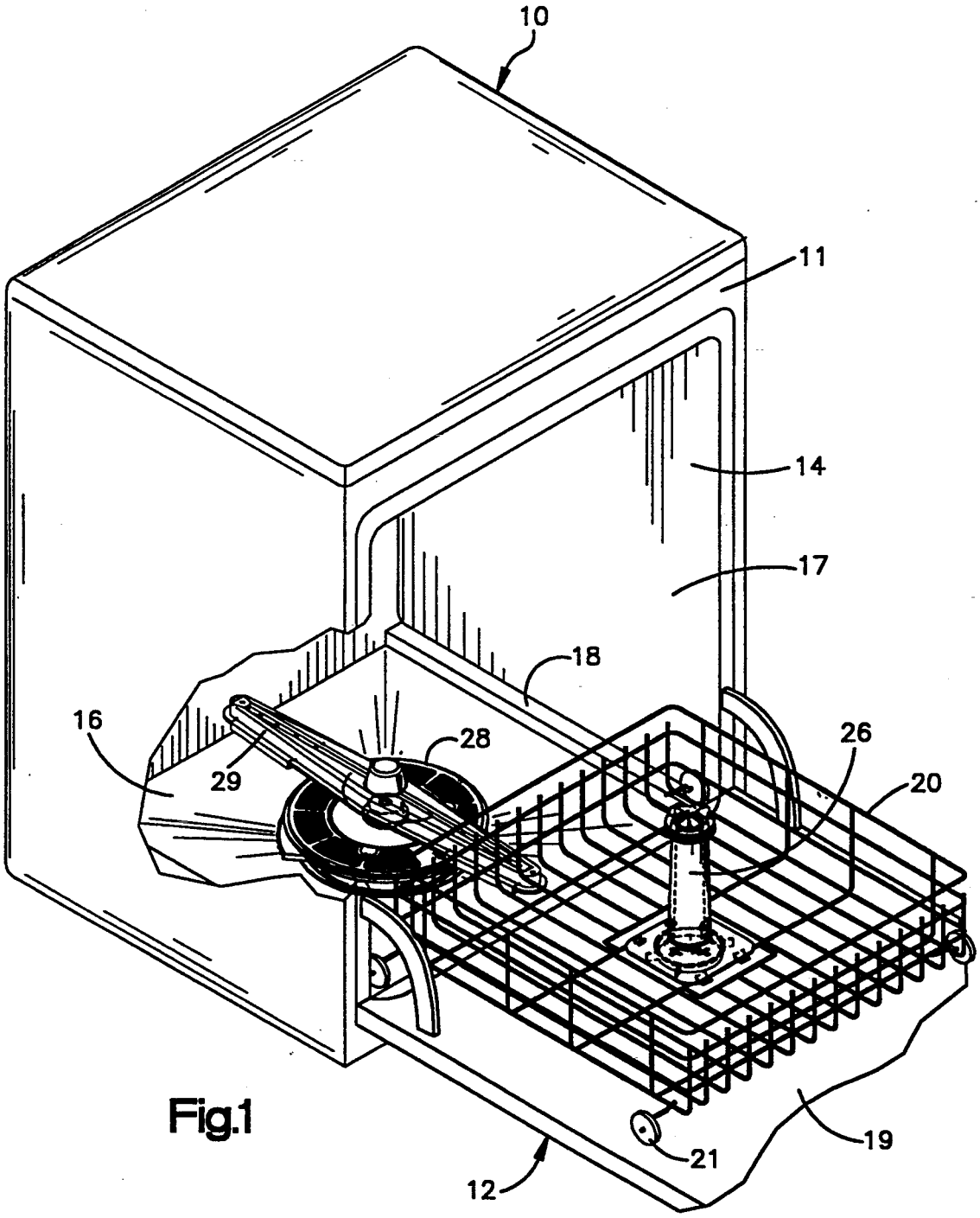
FIG. 1 is a perspective view of a dishwasher with the door open and the lower rack rolled out onto the door.
Figure 2:
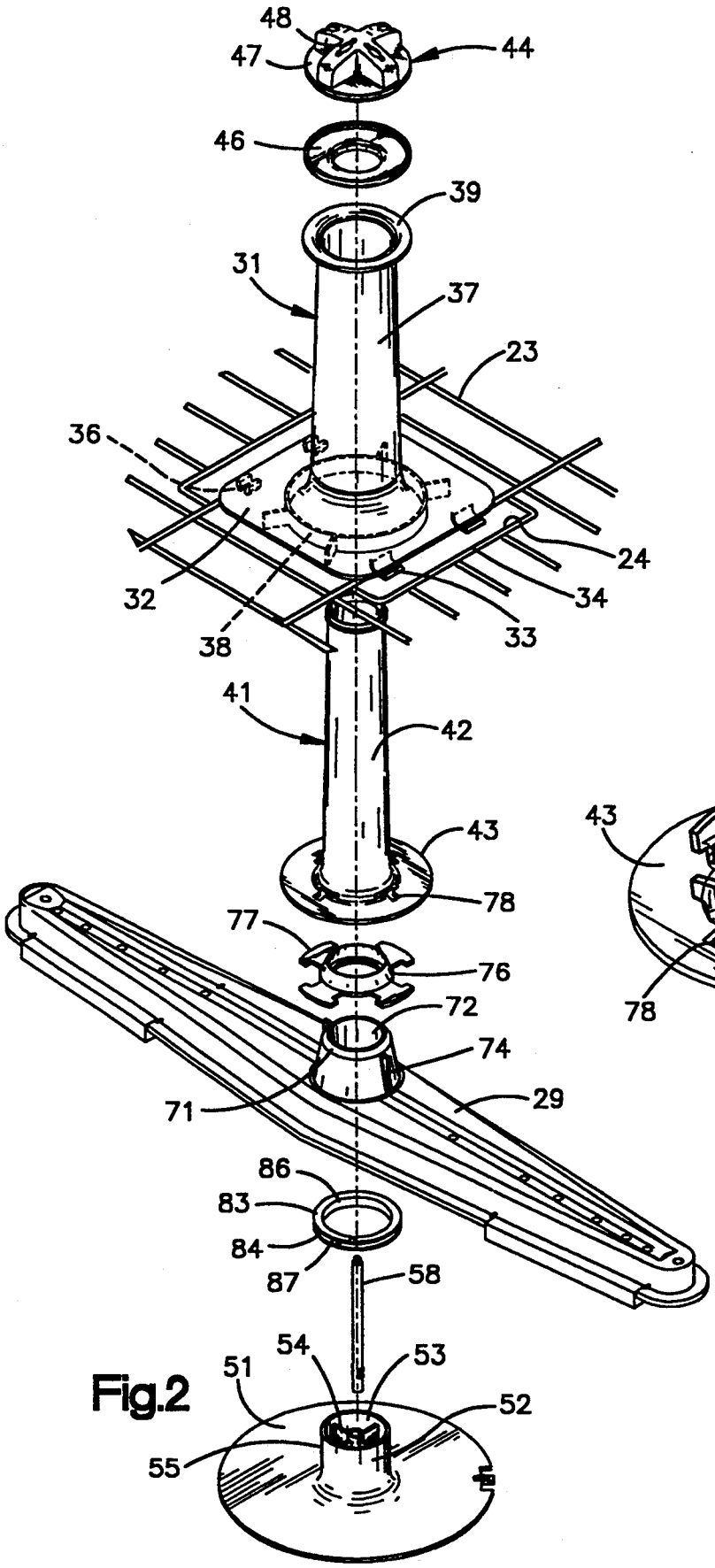
FIG. 2 is an exploded view of the tower assembly and lower washarm.
Figure 3:
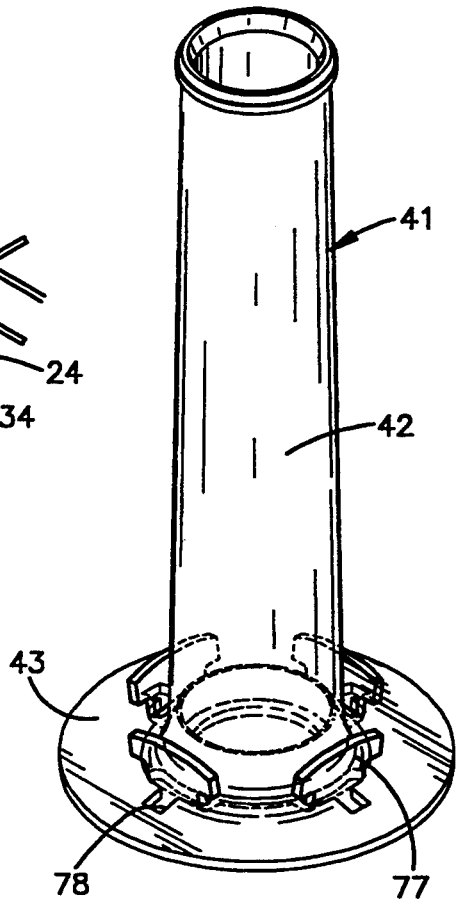
FIG. 3 is an enlarged perspective view of the fixed tower.
Figure 4:
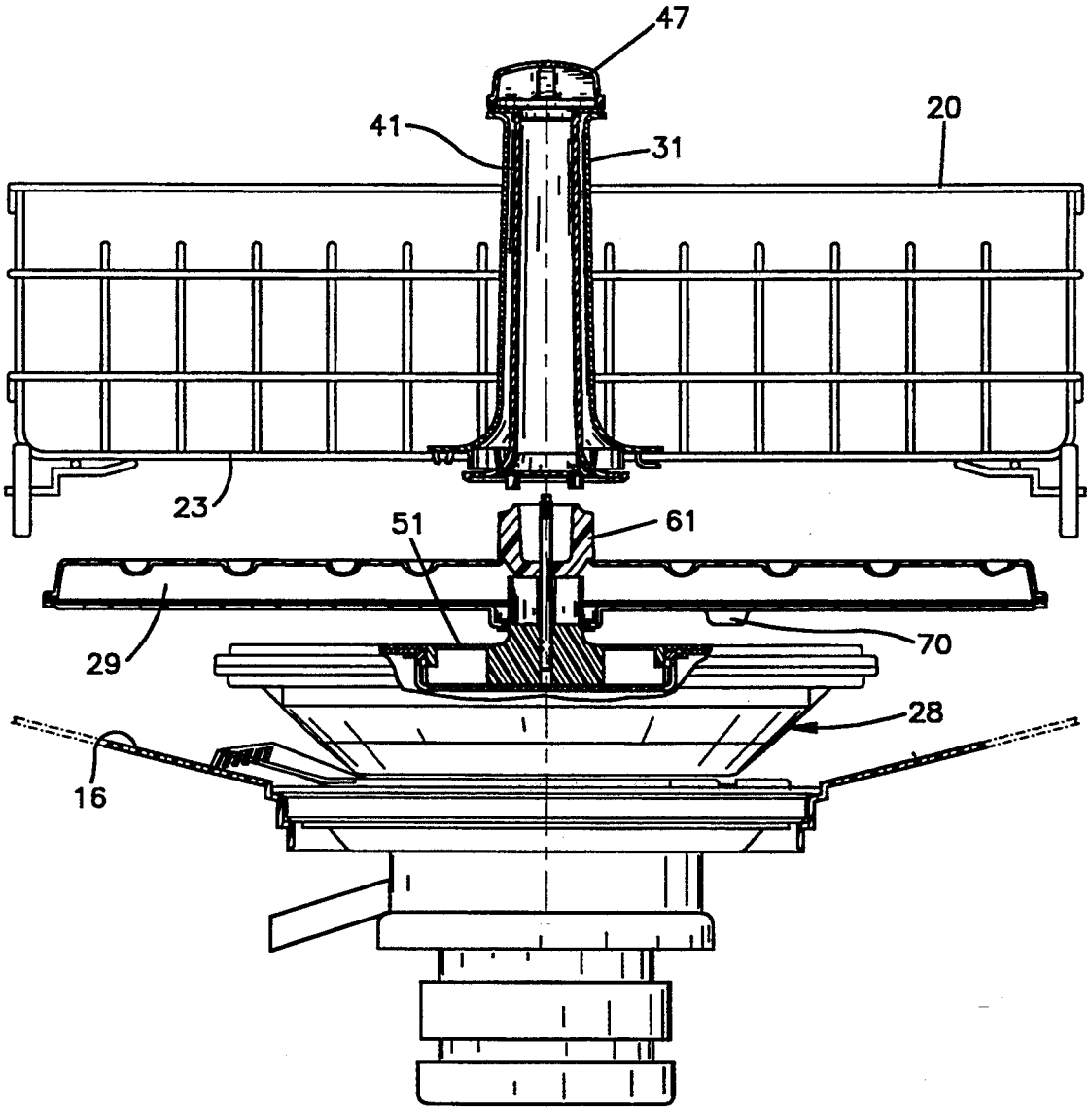
FIG. 4 is a fragmentary elevational view with some parts in section through the pump, tub, lower arm, and fixed tower with the washarm in the lower or inoperative position.

Referring to the drawings in greater detail, FIG. 1 shows a typical dishwasher 10 having parts broken away with the door in the open position. The dishwasher 10 includes a cabinet 11 and a downwardly opening door 12. The tub 14 fits within the cabinet 11 and has an open front side that is closed off by the door 12 when the dishwasher is in operation. The tub 14 includes a bottom wall 16 and upstanding side walls 17 which include rail portions 18 along the lower edges adjacent the bottom wall 16.

A lower rack 20 has wheels 21 which roll along the rail portions 18 which align with the inner door surface 19 when the door is in the open position, so that the rack 20 can roll from the inner position completely within the tub to an outer position on the door for loading or unloading. It will be understood that there is also an upper rack that is mounted on movable rails carried on the side walls 17 and is moveable in and out above the lower rack 20, but the upper rack has been omitted for purposes of clarity and forms no part of the present invention.

The lower rack 20 is formed of heavy wire bent to shape and generally covered with a rubber or plastic type material to prevent rust and to protect the articles loaded into the dishwasher. Rack 20 includes a bottom portion 23 which defines a central opening 24 and which serves to mount a tower assembly 26 which is secured directly to the lower rack over the central opening 24.

Also mounted on the bottom wall 16 is a pump assembly shown generally at 28. This pump assembly is more completely disclosed in the co-pending application of the present inventor, entitled "DISHWASHER PUMP AND FILTRATION SYSTEM", Ser. No. 0/846,596, filed Nov. 1, 1993, and assigned to the Assignee of the present invention. Directly above the pump is mounted a lower wash arm 29 which may be constructed in accordance with the co-pending application of Daniel R. Kirkland and Mark A. Sublette, entitled "CLEANING WASH-ARM FOR DISHWASHER FILTER", Ser. No. 08/056,996, filed May 4, 1993, and assigned to the Assignee of the present invention. Both of these applications are incorporated herein by reference.

The tower assembly 26 includes a fixed tower member 31 having a base 32 which fits over the central opening 24 and is retained to the rack wires 34 by means of hook portions 33 along one side, which fit beneath the wires, and snap portions 36 on the other side which snap over the adjacent wire. Extending upward from the base 32 is an outer tube 37 which terminates in an outwardly flaring flange 39 at its upper end. Below the base 32 is a lower annular wall 38 which aids in positioning the rotatable tower member 41 which fits inside the fixed tower member 31. The rotatable tower member 41 is preferably formed of a plastic material such as acetal resin which provides very low friction against the fixed tower member 31 which is preferably formed from a filled polypropylene plastic material. Because of this low friction, particularly when wetted by water throughout its surfaces, there is very little friction to prevent rotation of the rotatable tower member 41. The rotatable tower member 41 includes a tube portion 42 fitting within the fixed outer tube 37 as well as a flange 43 at its lower end which extends outward beneath the annular wall 38. At the upper end of tube portion 42 is a spray head 44 which includes a lower portion 46 secured to the tube portion 42 by suitable means such as sonic welding. Since lower portion 46 extends over the flange 39, the inner tube is effectively restrained within the outer tube against vertical movement in either direction. The spray head 44 includes a top portion 47 which may be formed with suitable openings 48 to spray the wash or rinse water in horizontal and vertical directions.

The pump assembly 28, which is located centrally in the bottom wall 16 which is sloped downwardly toward the pump to define a sump area or reservoir to supply the pump. The pump operates in a wash mode to pump water from the bottom wall sump to a wash arm and in a drain mode to pump water from the sump to drain. The pump assembly 28 includes a cover plate 51 having a tubular wash outlet 52 extending upward along its central axis and in line with the axis of the tower assembly 26. The outlet 52 has a cylindrical outer surface 55 and terminates in a planar opening 53. Web members 54 are located within the outlet 52 and support a centrally located hub 56 having an elongated bore 57 to receive a shaft 58 for journalling the wash arm. The shaft 58 is preferably metal and may be molded into the cover plate 51 when the latter is manufactured.

The lower wash arm 29 includes a central hub 61 having a vertically extending bore 62 therein to journal the washarm on the shaft 58. A nut 59 threaded on the upper end of shaft 58 limits upward movement so that the wash arm cannot accidently be disengaged. However, the vertical movement of the washarm is such that normally the hub 61 never contacts nut 59. Preferably, the washarm 29 is formed from upper and lower molded plastic pieces to define a left arm 63 and right arm 64 having upper surfaces 65 containing the spray openings 66 arranged to provide a balanced downward reaction force on the two arms and to spray upwardly and cover the entire lower rack 20 as the washarm rotates. These spray openings may be directed angularly to provide a driving force to rotate the washarm, or the washarm may be provided with spray jets 70 on the lower surface as described in greater detail in the aforesaid application Ser. No. 08/056,996. As shown, metal shields 67 may be provided on the washarm to cover the lower surface 68 and those areas which pass over a heater (not shown) that may be mounted around the tub bottom wall 16.

Between the left and right arm 63 and 64, and above central hub 61, the washarm 29 has a conical hub 69 extending upwardly to terminate in an even sharper conical tip 71 defining an opening 72. Vertically extending ribs 74 on the outside of conical hub 69 are engageable with projecting ears 75 extending downward from the flange 43. It will be noted that there are two ribs 74 and four ears 75 which are equally spaced so that the ribs can engage the ears in multiple positions. A rubber sealing grommet 76 is mounted directly below the flange 43 to be engageable by the conical tip 71 and is held in place by projecting ears 77 which fit in slots 78 on the flange 43. Thus, when the lower washarm moves upwardly, the conical tip 71 makes sealing engagement with the grommet 76 which, in turn, makes sealing engagement with the underside of flange 43. The water exiting through the opening 72 then passes upward through the rotatable tower member to the spray head 44 where it can spray the dishes in the upper rack and, if so desired, also spray downwardly on the dishes in the lower rack. Because of the grommet 76, effective sealing engagement is made so that there is little water leakage in this area.

However, as the washarm 29 moves up and downwardly, it is also necessary to provide a seal around the pump outlet 52. Accordingly, the washarm 29 has a centrally located collar 81 extending a short distance below the lower surfaces 68 in which terminates in an inturned lip 82 extending in a plane generally perpendicular to the axis of shaft 58. A seal member 83, preferably formed of acetal resin for its bearing properties when wet, is provided with an annular groove 84 on its outer radially surface which fits over the inturned lip 82 to serve as an additional bearing for the washarm. Seal 83 has a cylindrical inner surface 86 which fits against the outer surface 55 of tubular outlet 52 and the seal is provided with a skewed slit 87 to allow easy assembly onto the lip 82 while providing no significant gap for leakage. This inner surface 86 makes a sufficiently tight sealing engagement that it does not rotate with the washarm but remains stationary rotation wise on the outlet outer surface 55 so that the washarm rotates with respect to the seal. However, this fit is sufficiently loose that the seal can move vertically as the washarm moves upwardly into engagement with the rotary tower and back downward when the pump is not operating.

The seal 83 thus not only provides an effective seal to prevent leakage of the wash water that would decrease the flow through the washarm, but also provides an additional stabilizing bearing for the washarm that is below and outboard of the bearing provided by bore 62 rotating on shaft 58. The result is a very stable washarm that directs the flow of wash and rinse water for a maximum effectiveness.

Figures 5, 6:
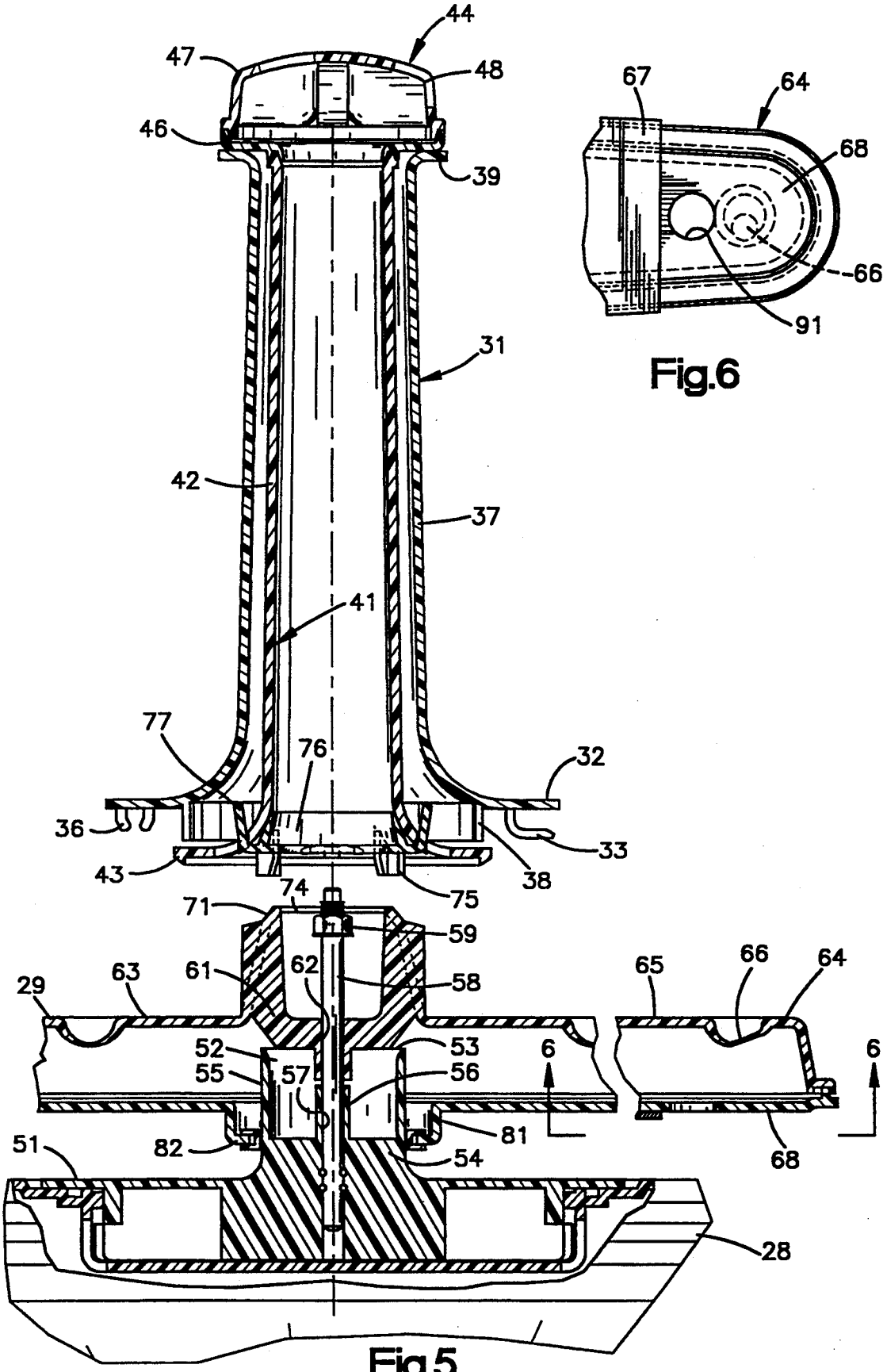
FIG. 5 is an enlarged fragmentary elevational view in sections similar to FIG. 4, but showing a slightly modified embodiment.
FIG. 6 is an enlarged view taken on line 6—6 of FIG. 5.
Figure 7:
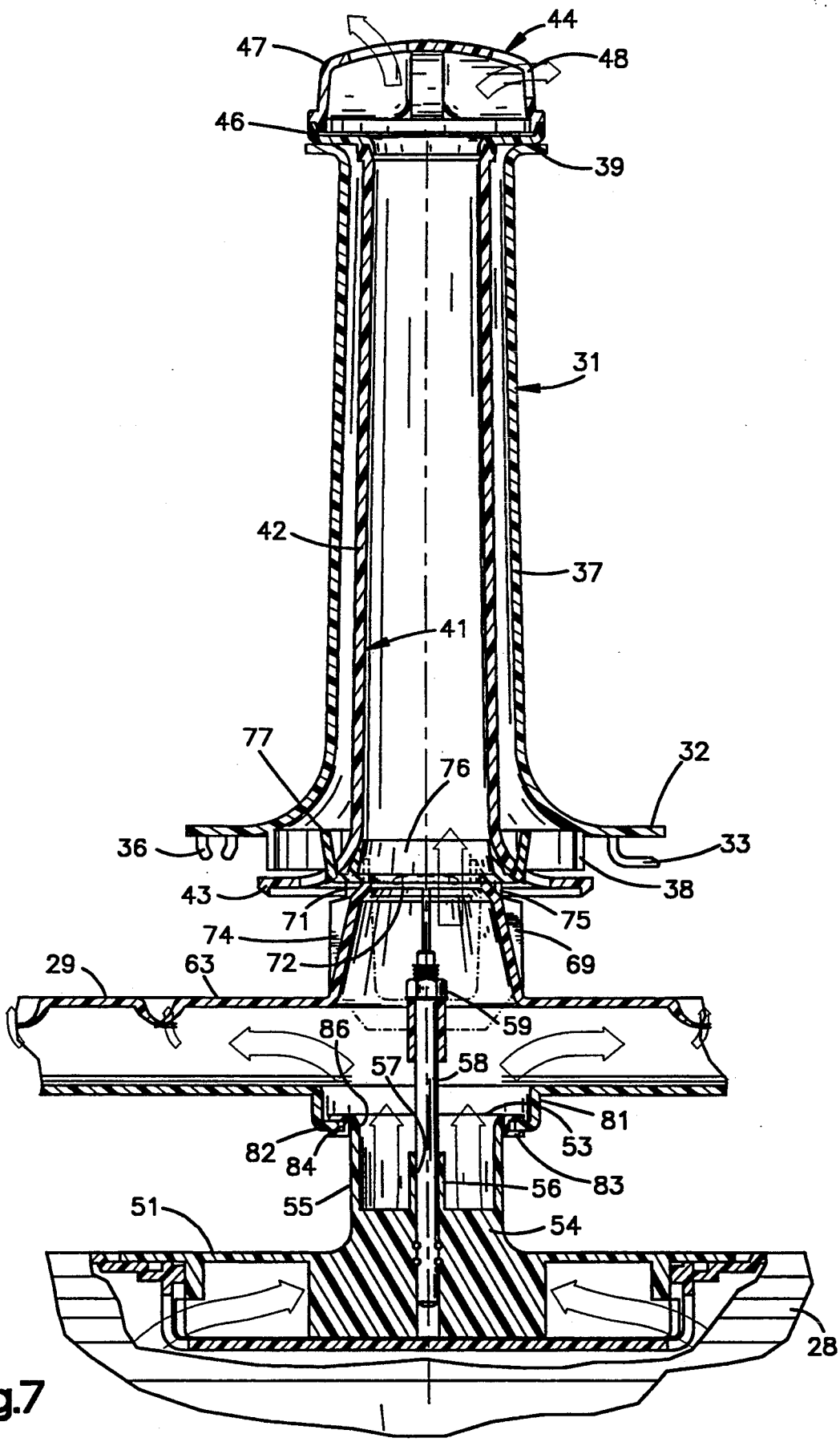
FIG. 7 is a view similar to FIG. 5 showing the washarm in the raised or operating position and slightly rotated at the hub to show flow passages.

The lifting of the washarm into engagement with the rotatable tower is caused by the area differential between the inlet area around the collar 81 and the outlet opening 72 in the hub conical tip. Since the latter is much smaller than the former, there is a net force tending to lift the washarm and this force is sufficient to insure proper engagement between the conical tip 71 and the grommet 76. However, if the output of the pump assembly 28, for one reason or another, is not sufficient to provide this pressure differential because the rate of flow into the washarm is insufficient or the outflow through the spray openings 66 is too great, additional lifting assistance may be provided as shown in FIGS. 5 and 6. This is done by providing an opening 91 in the lower surface 68 of both of the arms 63 and 64 near the outer end. These openings direct a water jet downward and this produces an upward reaction force on the washarm and assists in the lifting action. Washing test have indicated that the openings 91 also improve the washability performance by providing a downward spray over the tub bottom wall 16 tending to wash any soil particles toward the pump assembly 28 so that they may be trapped in the filter unit of the pump and promptly discharged to drain during the drain cycle.

Although the preferred embodiment of the invention has been shown and described in detail, it is recognized that various modifications and rearrangements may be resorted to without departing from the scope of the invention as defined in the claims.

We claim:

1. A dishwasher comprising a tub having an open face closable by a door, said tub having a bottom surface, a pump mounted below said bottom surface and having an outlet tube extending upward through said tub bottom surface, said tube having an outlet opening at its upper end and defining a vertical axis, a rack movably mounted in said tub above said bottom surface, said rack having a fixed tower secured to said rack and extending upward from said rack, a rotatable spray tower journalled on said fixed tower and having an inlet at the lower end adjacent said outlet tube, a rotatable spray arm mounted on said outlet tube for rotation about said vertical axis, said spray arm being movable vertically along said outlet tube for upward movement into driving and fluid conducting engagement with said rotatable spray tower and for downward movement out of engagement with rotatable spray tower, said outlet tube having a shaft extending upwards along said axis through said outlet opening, bearing means on said spray arm journalled on said shaft, and a seal member mounted on said spray arm for vertical movement with respect to said outlet tube but being nonrotatably carried by said outlet tube so that rotation of said spray arm is about said outlet tube and said seal member.

2. A dishwasher as set forth in claim 1, wherein said spray arm has a collar extending downward along the exterior of said outlet tube, said collar having an inturned lip at its lower end and said seal member fits on said lip.

3. A dishwasher as set forth in claim 2, wherein said seal member has a groove fitting on said inturned lip and a cylindrical surface engaging said outlet tube.

4. A dishwasher comprising a tub having an open face closable by a door, said tub having a bottom surface, a pump mounted below said bottom surface and having an outlet tube extending upward through said tub bottom surface, said tube having an outlet opening at its upper end and defining a vertical axis, a rack movably mounted in said tub above said bottom surface, said rack having a fixed tower secured to said rack and extending upward from said rack, a rotatable spray tower journalled on said fixed tower and having an inlet at the lower end adjacent said outlet tube, a rotatable spray arm mounted on said outlet tube for rotation about said vertical axis, said spray arm having at least two wash arms extending outward from said vertical axis, said spray arm being movable vertically along said outlet tube for upward movement into driving and fluid conducting engagement with said rotatable spray tower and for downward movement out of engagement with rotatable spray tower, said outlet tube having a shaft extending upwards along said axis through said outlet opening, bearing means on said spray arm journalled on said shaft, a seal member mounted on said spray arm for vertical movement with respect to said outlet tube, each of said wash arms having an outer end, each of said outer ends having a bottom surface adjacent said tub bottom surface and at least one spray opening in said wash arm bottom surface operable to spray wash water down onto said tub bottom surface and by reaction move said spray arm upward into engagement with said rotatable spray tower.

* * * * *

UNITED STATES PATENT AND TRADEMARK OFFICE

CERTIFICATE OF CORRECTION

PATENT NO. : 5,427,129

DATED : June 27, 1995

INVENTOR(S) : Raymond A. Young, Jr., et al.

It is certified that error appears in the above-indentified patent and that said Letters Patent is hereby corrected as shown below:

On the title page, item [73], Assignee, insert the following:
--White Consolidated Industries, Inc., Cleveland, Ohio--;

Under "Attorney, Agent, or Firm", insert the following:
--Pearne, Gordon, McCoy & Granger--.

Column 4, line 18, delete "0/846,596" and insert --08/146,596--.

Signed and Sealed this

Twenty-first Day of November, 1995

*Attest:*

*Attesting Officer*

BRUCE LEHMAN

*Commissioner of Patents and Trademarks*